US009121353B2

(12) United States Patent
Chang et al.

(10) Patent No.: US 9,121,353 B2
(45) Date of Patent: Sep. 1, 2015

(54) CONTROL STRUCTURE OF ENGINE THROTTLE VALVE

(71) Applicant: KWANG YANG MOTOR CO., LTD., Kaohsiung (TW)

(72) Inventors: Chi-Han Chang, Kaohsiung (TW); Chun-Hsiung Chen, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 281 days.

(21) Appl. No.: 13/654,424

(22) Filed: Oct. 18, 2012

(65) Prior Publication Data

US 2013/0125860 A1 May 23, 2013

(30) Foreign Application Priority Data

Nov. 23, 2011 (TW) ..... 100142873 A

(51) Int. Cl.
*F02D 9/08* (2006.01)
*F02D 9/10* (2006.01)
*F02D 9/00* (2006.01)

(52) U.S. Cl.
CPC .. *F02D 9/10* (2013.01); *F02D 9/08* (2013.01); *F02D 9/1055* (2013.01)

(58) Field of Classification Search
CPC ..... F16K 1/221; F16K 1/226; F02D 9/08; F02D 9/10; F02D 9/1055
USPC ..... 123/337, 382; 251/129.01, 129.02, 251/129.11
See application file for complete search history.

(56) References Cited

U.S. PATENT DOCUMENTS

| | | | | |
|---|---|---|---|---|
| 3,746,348 | A * | 7/1973 | Stone | 285/95 |
| 4,367,708 | A * | 1/1983 | Nakamura et al. | 123/339.17 |
| 5,111,775 | A * | 5/1992 | Sumida et al. | 123/41.1 |
| 6,070,458 | A * | 6/2000 | Nawa et al. | 73/114.36 |
| 6,116,215 | A * | 9/2000 | Soleanicov et al. | 123/399 |
| 6,263,898 | B1 * | 7/2001 | Vanderveen et al. | 137/15.25 |
| 6,386,178 | B1 * | 5/2002 | Rauch | 123/337 |
| 7,063,067 | B2 * | 6/2006 | Kado et al. | 123/399 |
| 7,082,923 | B2 * | 8/2006 | Yui et al. | 123/339.18 |
| 7,469,879 | B2 * | 12/2008 | Aoki | 251/129.11 |
| 2005/0098163 | A1 * | 5/2005 | Andoh et al. | 123/568.18 |
| 2009/0261279 | A1 * | 10/2009 | Tanner et al. | 251/62 |
| 2012/0240898 | A1 * | 9/2012 | Lemecha et al. | 123/350 |

* cited by examiner

*Primary Examiner* — Erick Solis
*Assistant Examiner* — Josh Campbell
(74) *Attorney, Agent, or Firm* — Leong C. Lei

(57) ABSTRACT

A control structure is provided for a throttle valve of engine. The throttle valve includes a throttle plate arranged inside the valve body and mounted to a control shaft having an end extending outside the valve body and received in a control seat mounted outside the valve body and having a shaft hole seat, a constraint block, a coupling hole seat, and a cable outlet section. A control assembly includes a return spring and a control rocker arm that includes a connection section forming a connection hole to be fit over the control shaft and a cable connection section, a positioning section, and a push section. The control motor is mounted to the coupling hole seat of the control seat and has a driving rod having a front tip section positioned against the push section of the control rocker arm. The control seat lid is secured to the control seat.

8 Claims, 7 Drawing Sheets

CONTROL STRUCTURE OF ENGINE THROTTLE VALVE

(a) TECHNICAL FIELD OF THE INVENTION

The present invention generally relates to a control structure of engine throttle valve, and more particularly to an engine throttle valve structure that avoids increase of overall size of the throttle valve and at the same time simplifies the installation engineering of engine intake system so as to improve operation performance of the engine.

(b) DESCRIPTION OF THE PRIOR ART

Referring to FIG. 1, the operation of an engine 1 is such that an electronic control unit (ECU) 11 controls to inject a proper amount of fuel into a combustion chamber 13 of the engine 1 through an injection device 12. The fuel is mixed with external fresh air drawn in through a throttle valve 2 (a variable intake device) to form a fuel mist. The electronic control unit 11 issues an ignition signal to an ignition coil 14 to cause an ignition device (a spark plug) 15 to operate and flame the mist, so as to drive reciprocal motion of a piston 16. The piston 16 in turn drives a crankshaft 17 to rotate thereby generating power.

When a vehicle is not in a driving status, the engine 1 is operated in a low sped (idle) so as to prevent the engine 1 from shutdown. When the engine 1 in the idle speed, the electronic control unit 11 reduces the amount of fuel injected from the injection device and supplies fresh air through an idle intake bypass passage 21 that is arranged beside the variable intake device 2. The idle intake bypass passage 21 is provided with an electronic control valve 211. The electronic control valve 211 controls the amount of external fresh air drawn in so as to maintain the engine 1 operating in a constant idle speed.

The conventional engine 1 uses the idle intake bypass passage 21 and the electronic control device 211 arranged beside the throttle valve 2 to maintain the constant idle speed of the engine 1 so as to keep the engine 1 from being shut down and reduce fuel consumption. As shown in FIG. 2, the engine 1 is additionally coupled to a generator 3 or other power device. The generator 3 is activated only when the engine 1 is operating in the idle speed. This inevitably causes a great increase of loading of the engine 1. To maintain normal operation of the additionally coupled generator 3, the engine 1 must raises the operation speed thereof. The conventional way of intake for the engine 1 is obviously not capable of handling the instantaneous increase of loading when the engine 1 is in the idle speed and also the amount of intake air must be increased to meet the need of increasing speed of the engine 1. Thus, it is a challenge of the vehicle manufacturing industry to provide a control structure of throttle valve 2 that allow the engine 1 to handle air intake for both non-loaded idling and loaded idling.

SUMMARY OF THE INVENTION

The primary technical solution of the present invention is to provide a control structure of throttle valve of engine. The throttle valve at least comprises a valve body, a throttle plate, a control seat, a control assembly, a control motor, and a control seat lid. The throttle plate is arranged inside the valve body and mounted to a control shaft having an end extending outside the valve body and received in the control seat. The control seat is mounted outside the valve body and comprises a shaft hole seat, a constraint block, a coupling hole seat, and a cable outlet section. The control assembly comprises a return spring and a control rocker arm that comprises a connection section forming a connection hole to be fit over the control shaft. The control rocker arm also comprises a cable connection section, a positioning section, and a push section. The control motor is mounted to the coupling hole seat of the control seat and has a front side where a driving rod is mounted. The driving rod has a front tip section positioned against the push section of the control rocker arm. The control seat lid is secured to the control seat. This arrangement prevents enlargement of the overall size of the throttle valve and simplifies the installation engineering of the engine intake system so as to improve the operation performance of the engine.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
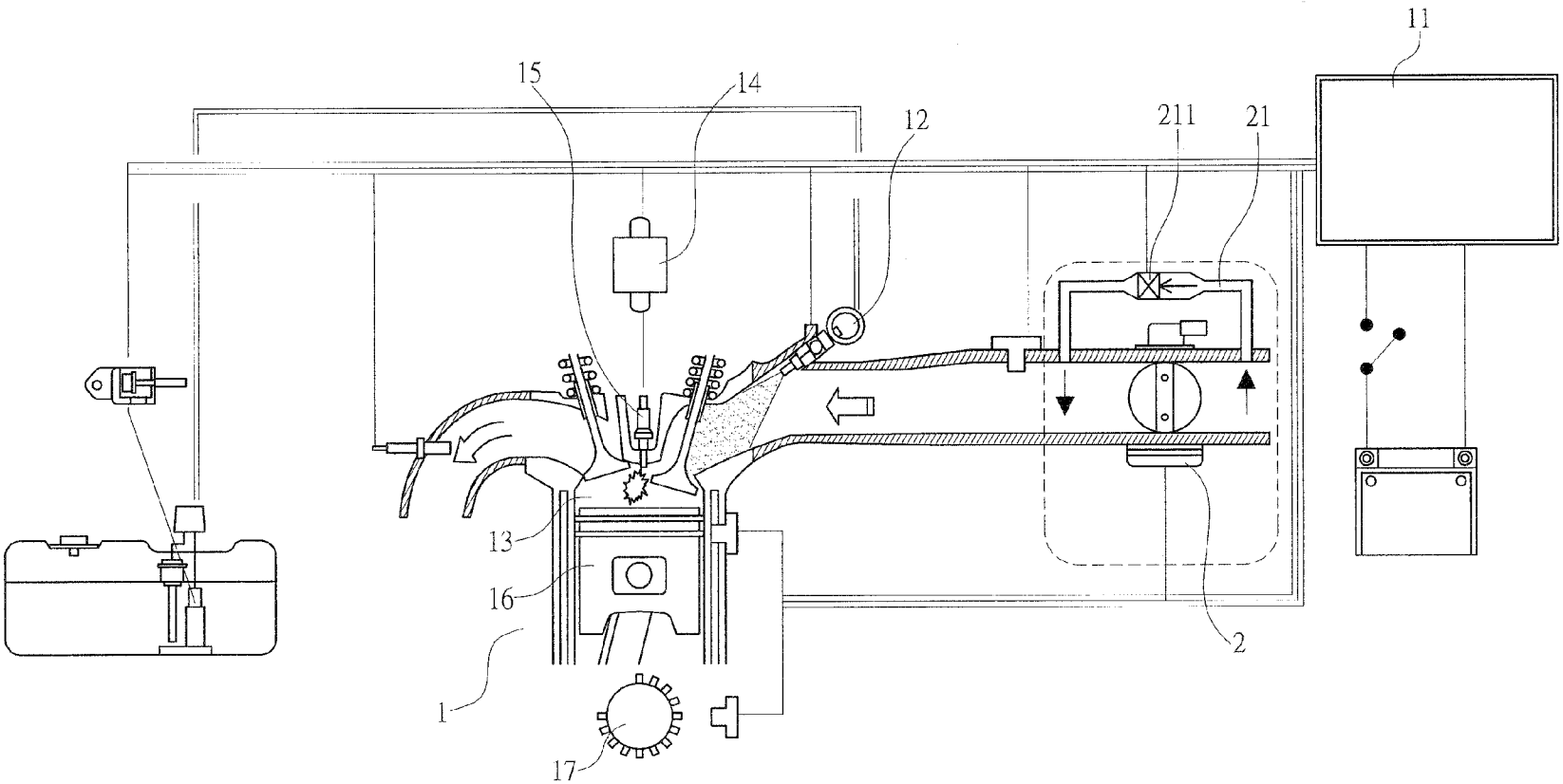
PRIOR ART FIG.1
FIG. 1 is a schematic view illustrating the operation of a conventional engine.
Figure 2:
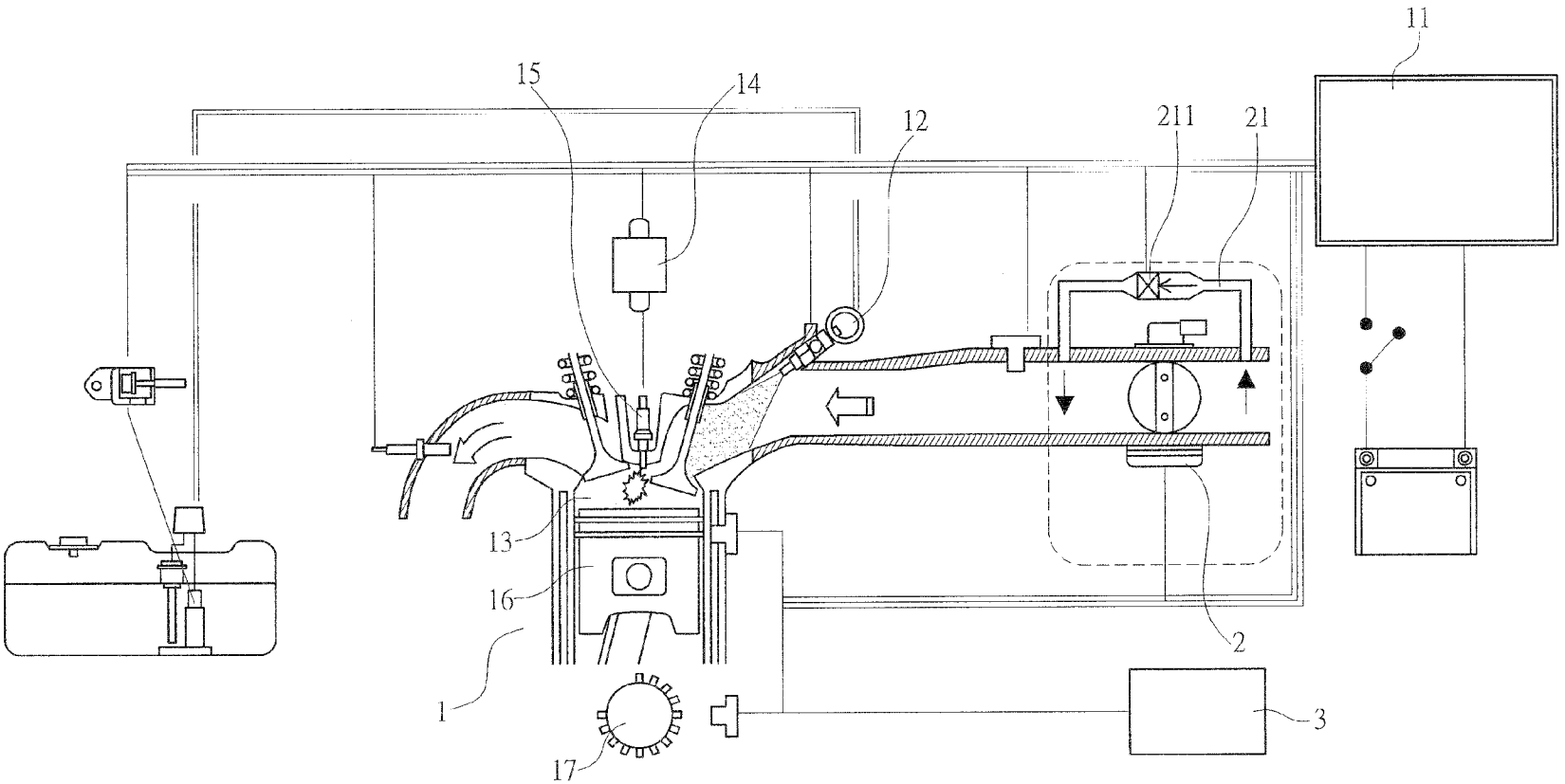
PRIOR ART FIG.2
FIG. 2 is a schematic view illustrating the operation of a conventional engine coupled to an external loading device.
Figure 3:
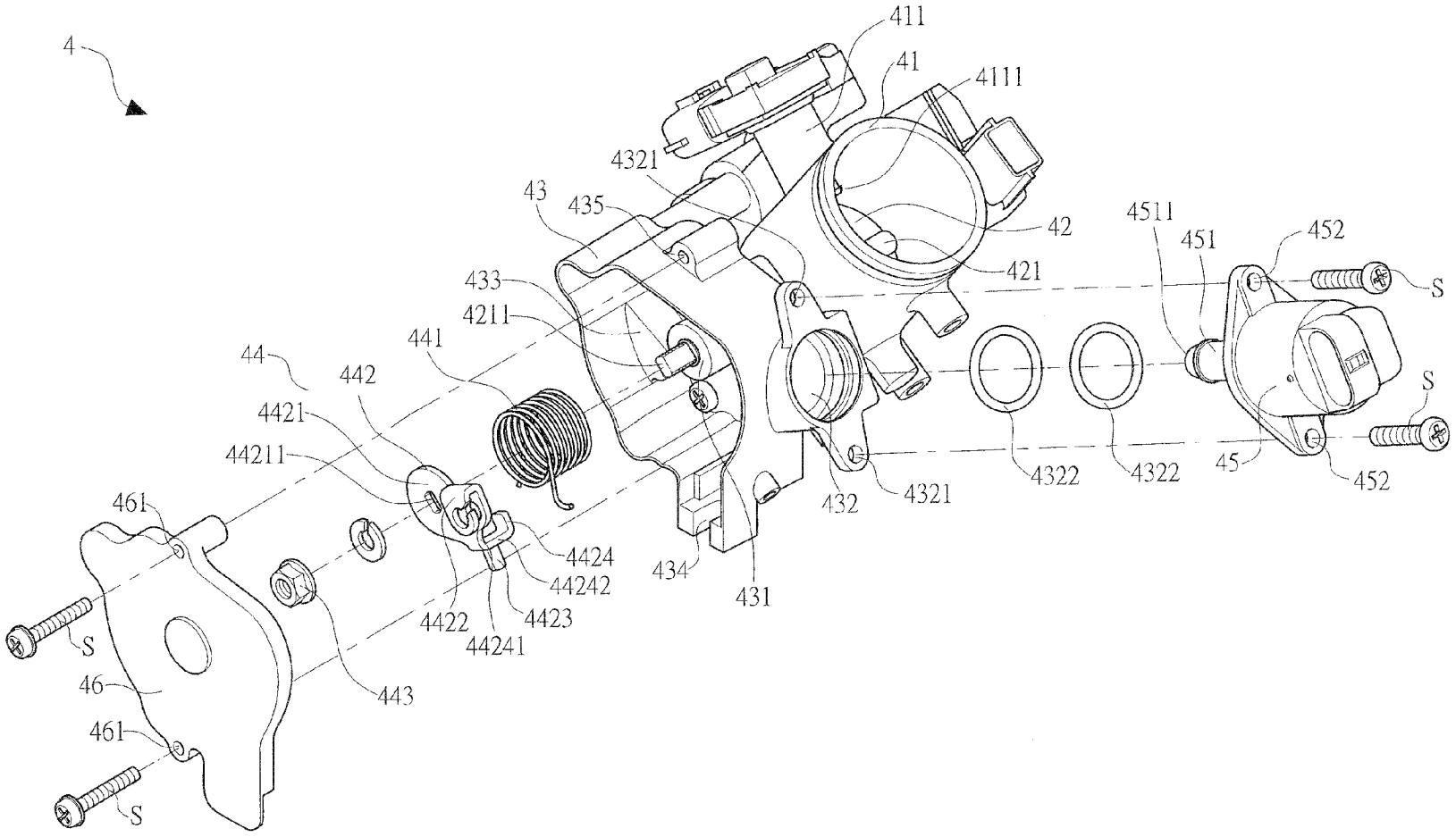
FIG. 3 is an exploded view showing a throttle valve according to the present invention.
Figure 4:
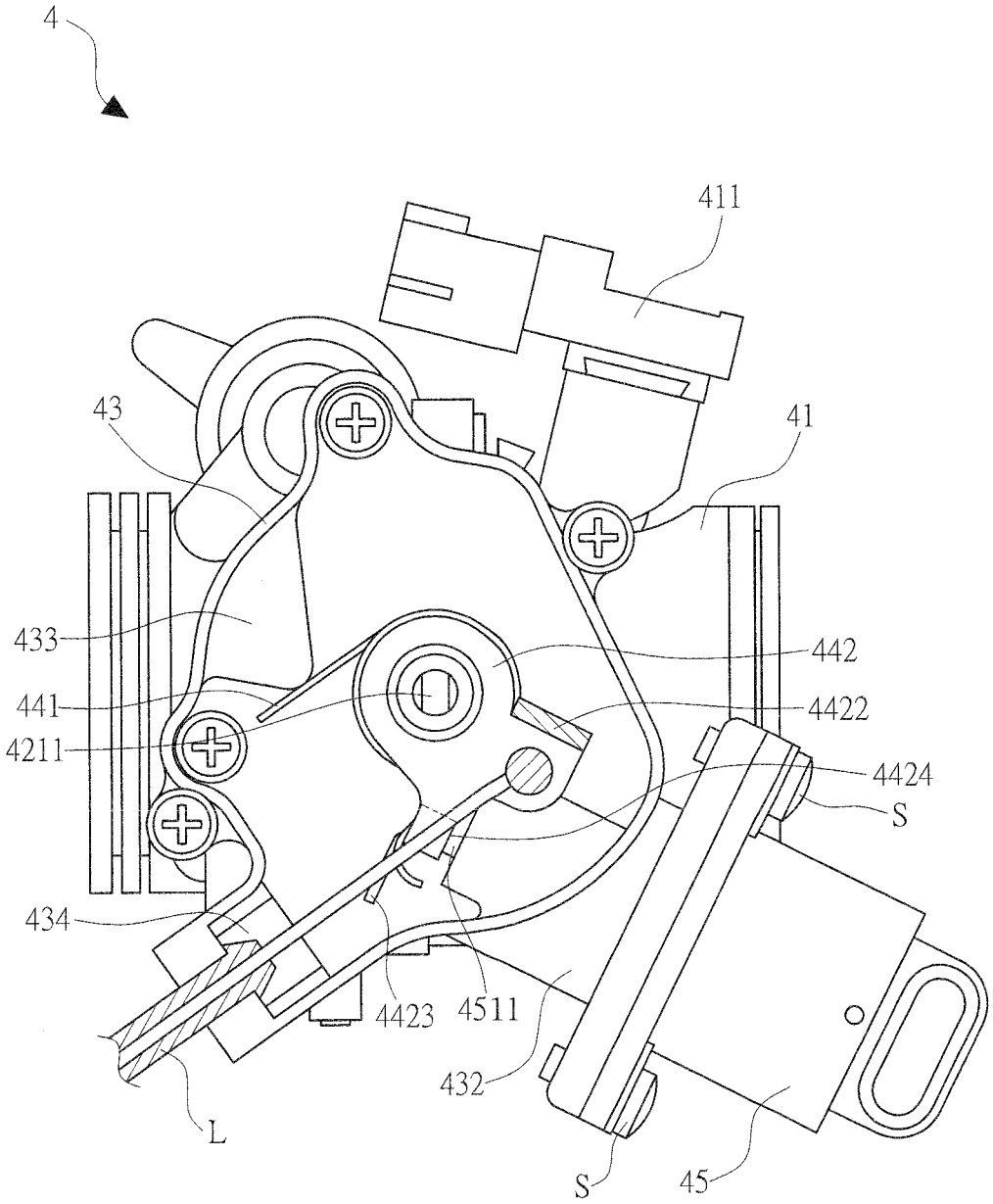
FIG. 4 is a perspective view showing the throttle valve.

Firstly, referring to FIGS. 3 and 4, the present invention provides a control structure of throttle valve of engine. The throttle valve 4 at least comprises a valve body 41, a throttle plate 42, a control seat 43, a control assembly 44, a control motor 45, and a control seat lid 46.

The valve body 41 has an outer circumference to which at least an intake pressure sensor 411 is mounted. The intake pressure sensor 411 has a detection terminal 4111 that extends into the interior of the valve body 41 in order to detect the amount of air intake of the throttle valve 4.

The throttle plate 42 is arranged inside the valve body 41. The throttle plate 42 is mounted to a control shaft 421, whereby the throttle plate 42 is rotatable about a rotation axis defined by the control shaft 421 and is thus allowed to do elevational swing motion inside the valve body 41. The elevation angle that the throttle plate 42 takes is the angle that the throttle plate 42 opens inside the valve body 41 for air intake. The control shaft 421 has an end forming a threaded section 4211. The threaded section 4211 of the control shaft 421 extends outside the valve body 41 to be received in the control seat 43.

The control seat 43 is mounted outside the valve body 41. The control seat 43 comprises a shaft hole seat 431. The shaft hole seat 431 receives the extension of the threaded section 4211 of the control shaft 421. The control seat 43 has one side forming a coupling hole seat 432. The coupling hole seat 432 receives the control motor 45 to coupled thereto. The coupling hole seat 432 has two side projections forming two mounting holes 4321 respectively. The coupling hole seat 432 comprises therein sealing rings 4322. The control seat 43 comprises a constraint block 433 that is located adjacent to the shaft hole seat 431 and is raised from the bottom. The coupling hole seat 432, the shaft hole seat 431, and the constraint block 433 are arranged to be substantially on a line. Precisely speaking, the shaft hole seat 431 is located between the coupling hole seat 432 and the constraint block 433. The control seat 43 forms on one side thereof a cable outlet section 434. The control seat 43 has an outer circumference forming a plurality of fixing holes 435.

The control assembly 44 comprises a return spring 441 and a control rocker arm 442. The control rocker arm 442 comprises a connection section 4421. The connection section 4421 forms a connection hole 44211. The connection hole 44211 is fit over the threaded section 4211 of the control shaft 421 with a locking nut 443 threadingly engaging the threaded section 4211 so as to couple the control rocker aim 442 to the threaded section 4211 of the control shaft 421. The control rocker arm 442 also comprises a cable connection section 4422, a positioning section 4423, and a push section 4424. The cable connection section 4422 is provided for connection with an accelerator cable L. The push section 4424 is formed by first extending downward from the cable connection section 4422 as a vertical segment 44241 and then sideways extending as a horizontal segment 44242 with a free end of the horizontal segment 44242 being made upward projecting. The positioning section 4423 comprises a projection peg extending downward. When the positioning section 4423 is brought into contact with the constraint block 433 of the control seat 43, the throttle plate 42 is set at the maximum opening inside the valve body 41. The return spring 441 has an end supported on the constraint block 433 of the control seat 43 and an opposite end supported on the push section 4424 of the control rocker arm 442.

The control motor 45 can be a step motor. The control motor 45 is mounted to the coupling hole seat 432 of the control seat 43. The control motor 45 has a front side where a driving rod 451 is provided. The driving rod 451 is driven by the control motor 45 to do linear extension/retraction. Further, the control motor 45 comprises two coupling holes 452 formed on side projections thereof. The coupling holes 452 are set to correspond to the mounting holes 4321 of the coupling hole seat 432 of the control seat 43, whereby when the control motor 45 is fit into the coupling hole seat 432 of the control seat 43, the threaded fasteners S can be put through the coupling holes 45 and the mounting holes 4321 of the coupling hole seat 432 to mount the control motor 45 to the coupling hole seat 432 of the control seat 43. When the control motor 45 is mounted to the coupling hole seat 432 of the control seat 43, a front tip section 4511 of the driving rod 451 of the control motor 45 is exactly positioned against the push section 4424 of the control rocker arm 442.

The control seat lid 46 is arranged to correspond to the control seat 43. The control seat lid 46 forms a plurality of through holes 461. The through holes 461 respectively correspond to the fixing holes 435 of the control seat 43, so that threaded fasteners S can be put through the through holes 461 and the fixing holes 435 to secure the control seat lid 46 to the control seat 43.

Figure 5:
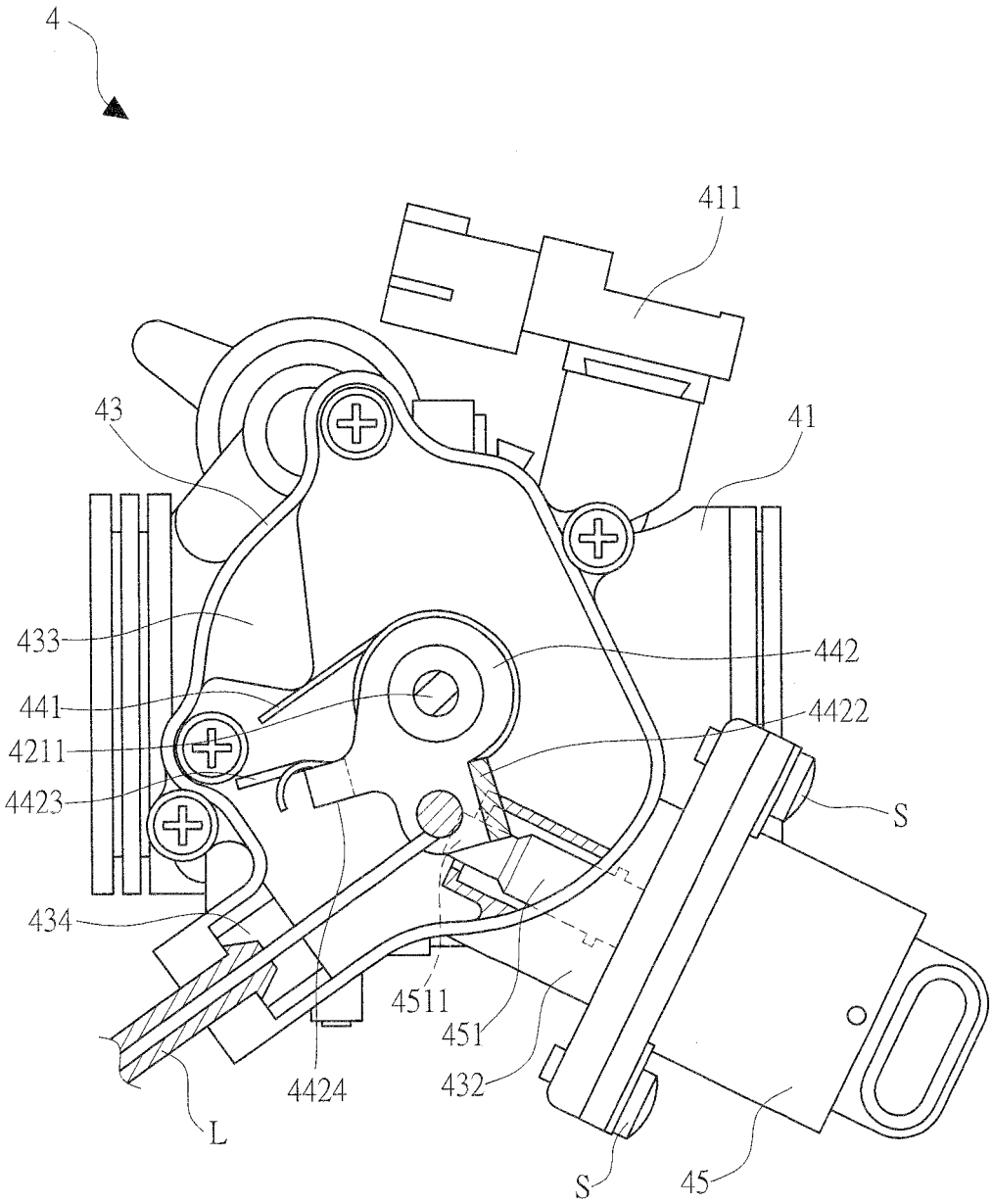
FIG. 5 is a schematic view illustrating the maximum opening of the throttle valve according to the present invention.
Figure 6:
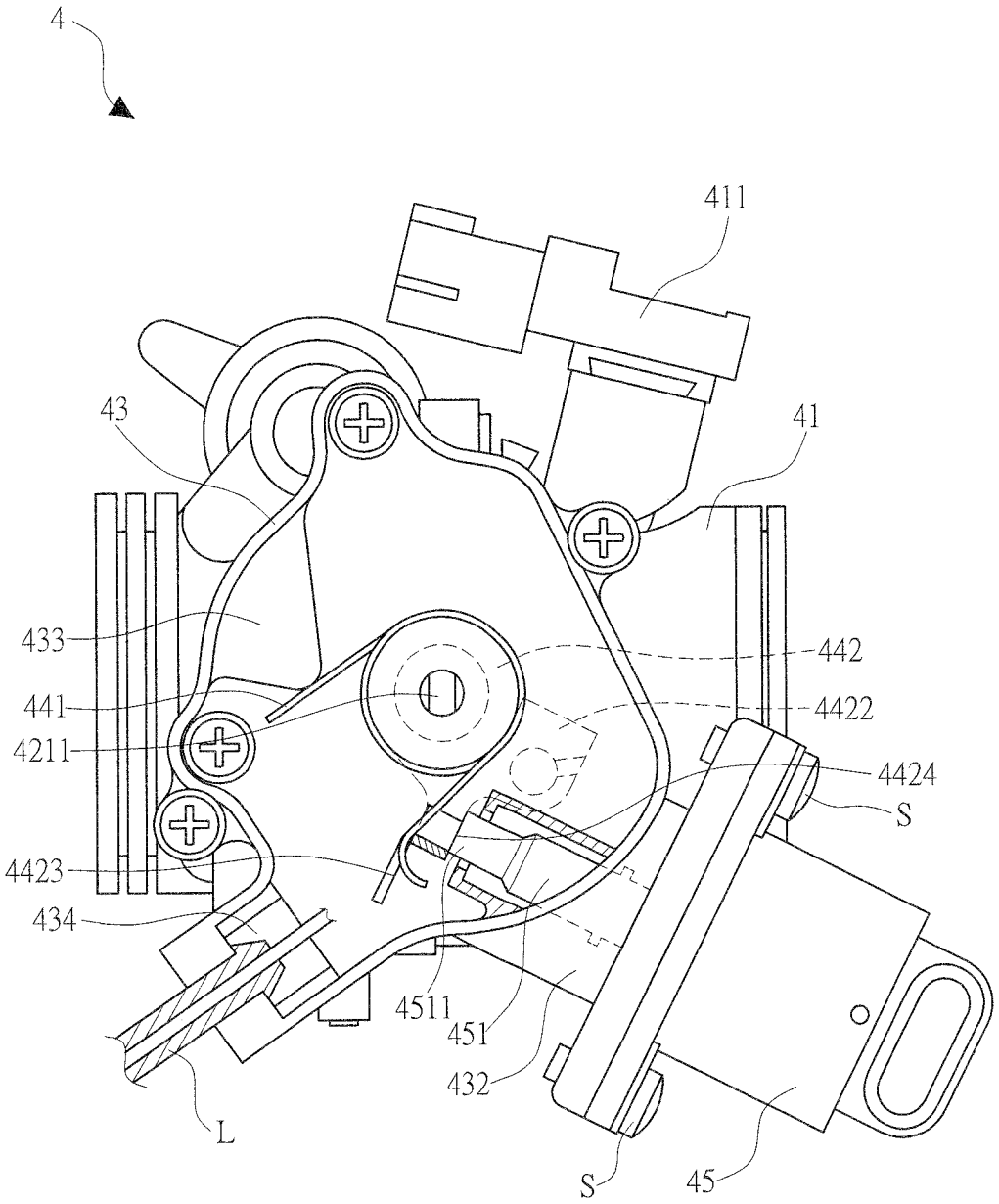
FIG. 6 is a schematic view illustrating the operation of the throttle valve according to the present invention for engine low idling speed.

To practice the present invention, referring to FIGS. 4, 5, 6, and 7, for a vehicle being not driven for a long time (namely the engine is in a cold condition), if a driver wishes to start the engine, at this moment, the throttle valve 4 is controlled by an electronic control unit (not shown) so that the control motor 45 of the throttle valve 4 is thus controlled by the electronic control unit to put the control motor 45 into operation, wherein the control motor 45 instructs the driving rod 451 to move forward by a small stroke. As shown in FIG. 6, the driving rod 451 of the control motor 45 is set in contact with the push section 4424 of the control rocker arm 442 of the control assembly 44, whereby when the driving rod 451 moves forward by a small stroke, the control rocker arm 442 is rotated simultaneously. The control rocker arm 442 causes the throttle plate 42 to make a small opening in the valve body 41 in order to bring in more intake air, allowing the engine to smoothly start even in the cold condition. Under this condition, the throttle plate 42 has a small opening in the valve body 41, which means the control motor 45 controls the throttle plate 42 to provide a first idling opening. Precisely speaking, the control motor 45 controls the throttle plate 42 to provide such an opening that allows the air intake that is needed for the engine to start in a cold and load-free condition. When the engine is warmed up, the electronic control unit controls the control motor 45 to return and this allows the throttle plate 42 to return to the home position. Under this condition, the engine is supplied by the throttle valve 4 with an idling intake air that is necessary for the engine in a load-free condition to maintain continuous operation of the engine in an idle speed.

When the vehicle is in driving condition after being warmed up, the throttle valve 4 uses the accelerator cable L to actuate the control rocker arm 442 of the control assembly 44 and uses the control rocker arm 442 to have the throttle plate 42 open in the valve body 41 to such an opening degree that matches the rotation of the acceleration handgrip (not shown) made by a rider, so as to have the engine (not shown in the drawing) to output a proper amount of power for moving the vehicle forward, as shown in FIGS. 4 and 5.

Figure 7:
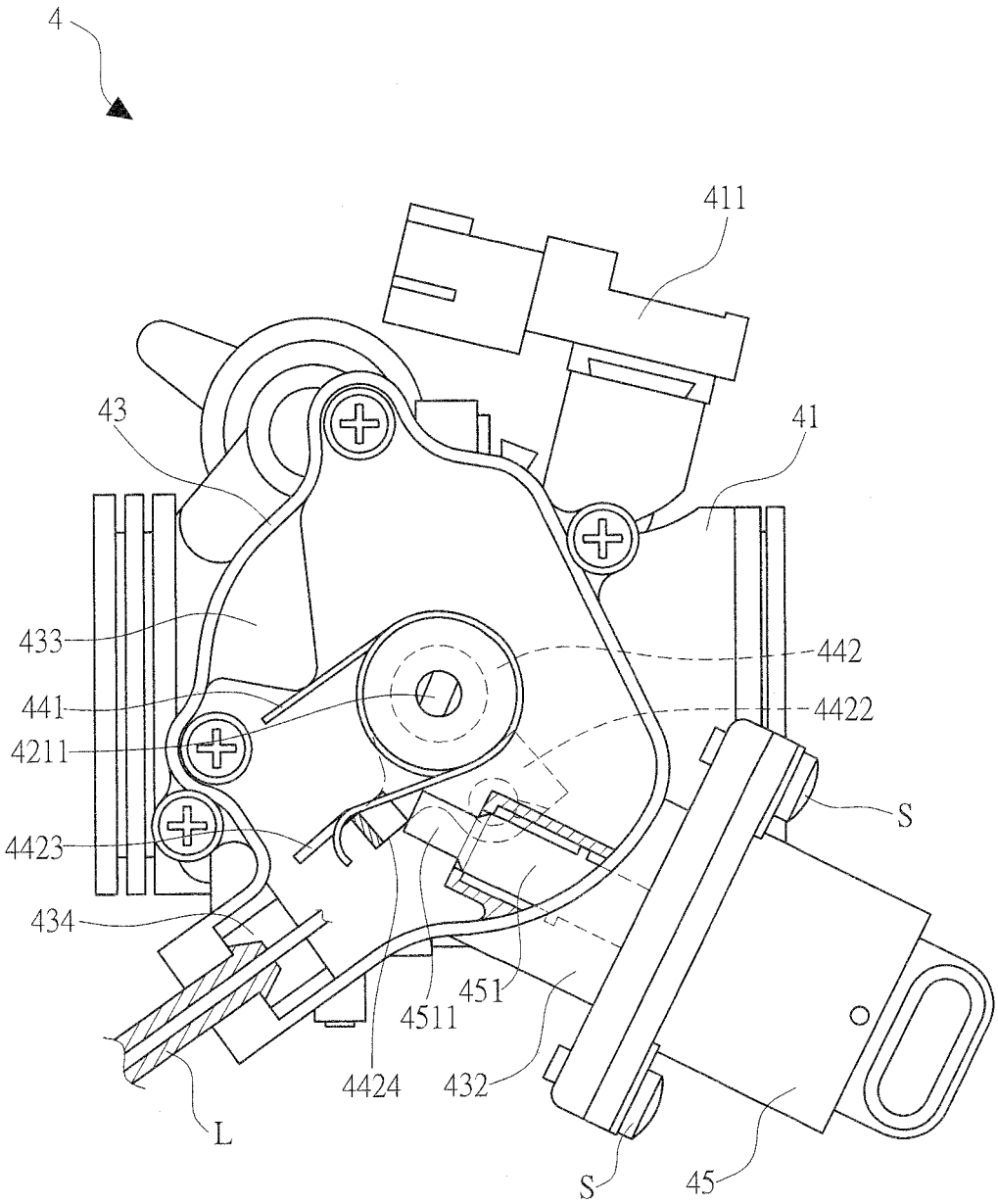
FIG. 7 is a schematic view illustrating the operation of the throttle valve according to the present invention for engine high idling speed.

When the vehicle has been started but does not move, it is the idle condition. However, with the engine being in the normal idle condition, when a rider activates an external dynamo or other power device connected to the engine, the electronic control unit makes an immediate control for re-operating the control motor 45 to further move the driving rod 451 forward by a stroke, as shown in FIG. 7, the driving rod 451 makes the control rocker arm 442 rotating again and the control rocker arm 442 makes the throttle plate 42 to open to an increased degree inside the valve body 41. In other words, the control motor 45 controls the throttle plate 42 to provide a second idling opening. Precisely speaking, the control motor 45 controls the throttle plate 42 to provide such an opening that allows the air intakes that is needed for the engine in a loaded idling condition to thereby increase the amount of air intake of the throttle valve 4, by which the amount of air intake for maintaining the engine in a high idling speed is supplied to ensure the normal operation of the engine in high loading and high idling speed.

The efficacy of the present invention is that a control seat 42 is provided on the throttle valve 4 and the control seat 42 comprises a control motor 45 mounted thereto. The control motor 45 is controlled by an electronic control unit and the control motor 45 is in operative coupling with the control rocker arm 442 of the control assembly 44. This prevents enlargement of the overall size of the throttle valve 4 and simplifies installation engineering of the engine intake system to thereby improving the performance of engine.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A control structure of a throttle valve of an engine, the throttle valve at least comprising a valve body, a throttle plate, a control seat, a control assembly, a control motor, and a control seat lid:

the throttle plate being arranged inside the valve body, the throttle plate being mounted to a control shaft, the control shaft having an end extending outside the valve body and received in the control seat;

the control seat being mounted outside the valve body, the control seat comprising a shaft hole seat, a constraint block, a coupling hole seat, and a cable outlet section, wherein the coupling hole seat has outside projections forming mounting holes, the coupling hole seat receiving therein a sealing ring, the shaft hole seat being located between the coupling hole seat and the constraint block;

the control assembly comprising a return spring and a control rocker arm, the control rocker arm comprising a connection section, the connection section forming a connection hole, the connection hole being fit over the control shaft, the control rocker arm comprising a cable connection section, a positioning section, and a push section, wherein the return spring has an end supported on the constraint block of the control seat and an opposite end supported on the push section of the control rocker arm; wherein the push section consists of a horizontal segment attached to the cable connection section by a first vertical segment, and a second vertical segment that extends toward, but does not contact the cable connection section;

the control motor being mounted to the coupling hole seat of the control seat, the control motor having a front side where a driving rod is mounted, the driving rod having a front tip section positioned against the push section of the control rocker arm, the control motor having side projections forming coupling holes, the coupling holes corresponding to the mounting holes of the coupling hole seat of the control seat; and the control seat lid being secured to the control seat.

2. The control structure of a throttle valve of an engine as claimed in claim 1, wherein the control motor is controlled by an electronic control unit to operate.

3. The control structure of a throttle valve of an engine as claimed in claim 1, wherein the valve body has an outer circumference to which at least an intake pressure sensor is mounted, the intake pressure sensor having a detection terminal extending into the valve body.

4. The control structure of a throttle valve of an engine as claimed in claim 1, wherein the control shaft has an end forming a threaded section, the threaded section of the control shaft extending outside the valve body and received in the control seat, the control rocker arm being mounted to the threaded section of the control shaft.

5. The control structure of a throttle valve of an engine as claimed in claim 1, wherein the control motor controls the throttle plate to switch between a first idling opening and a second idling opening.

6. The control structure of a throttle valve of an engine as claimed in claim 5, wherein the control motor controls the throttle plate forming the first idling opening to provide air intake for the engine in a cold and load-free condition.

7. The control structure of a throttle valve of an engine as claimed in claim 5, wherein the control motor controls the throttle plate forming the second idling opening to provide air intake for the engine in a loaded idling condition.

8. The control structure of a throttle valve of an engine as claimed in claim 1, wherein the positioning section comprises a projection peg extending downward, whereby when the positioning section is put in contact with the constraint block of the control seat, the throttle plate is set at a maximum opening in the valve body.

* * * * *